United States Patent [19]

Storm

[11] Patent Number: 4,492,326

[45] Date of Patent: Jan. 8, 1985

[54] SLING-TYPE INFANT CARRIER

[75] Inventor: Linda W. Storm, White Sands Missile Range, N. Mex.

[73] Assignee: Babies by Storm, Inc., Springfield, Ohio

[21] Appl. No.: 479,917

[22] Filed: Mar. 28, 1983

[51] Int. Cl.[3] ..... A47D 13/02

[52] U.S. Cl. ..... 224/160; 224/159; D3/99

[58] Field of Search ..... 224/160, 159; D3/99

[56] References Cited

U.S. PATENT DOCUMENTS

| | | | |
|---|---|---|---|
| D. 247,199 | 2/1978 | Carter | D3/2 |
| D. 253,558 | 12/1979 | Carter | D3/99 |
| D. 266,800 | 11/1982 | Kula et al. | D3/99 |
| 3,162,343 | 12/1964 | Anderson | 224/160 |
| 3,481,517 | 12/1969 | Aukerman . | |
| 3,780,919 | 12/1973 | Hansson . | |
| 4,009,808 | 3/1977 | Sharp . | |
| 4,149,687 | 4/1979 | Nunemacher | 224/159 |
| 4,234,229 | 11/1980 | Arnold | 297/467 |
| 4,271,998 | 6/1981 | Ruggiano | 224/160 |

FOREIGN PATENT DOCUMENTS

| | | | |
|---|---|---|---|
| 167146 | 4/1950 | Austria | 224/160 |
| 2028633 | 3/1980 | United Kingdom | 224/160 |

*Primary Examiner*—Steven M. Pollard

*Attorney, Agent, or Firm*—Cushman, Darby & Cushman

[57] ABSTRACT

A sling-type infant carrier is provided, typically sewn of fabric to include an approximately rectangular body, with a lower set of straps to girdle the adult at mid-torso and an upper set of straps each for crossing over the adult's respective one shoulder and under the adult's opposite underarm. The upper set of straps preferably centrally incorporates a pillow/chin-rest. The carrier body preferably includes a plurality of horizontal pleats which may be let out to accommodate growth of the infant. And the carrier body, which is configured to provide the infant with a comfortable seat when the infant is slung in confronting relation, preferably includes an adjustable width-reducing strap for easily reconfiguring the infant carrier for the infant's comfort when the infant is to be carried in a facing-out orientation.

8 Claims, 5 Drawing Figures

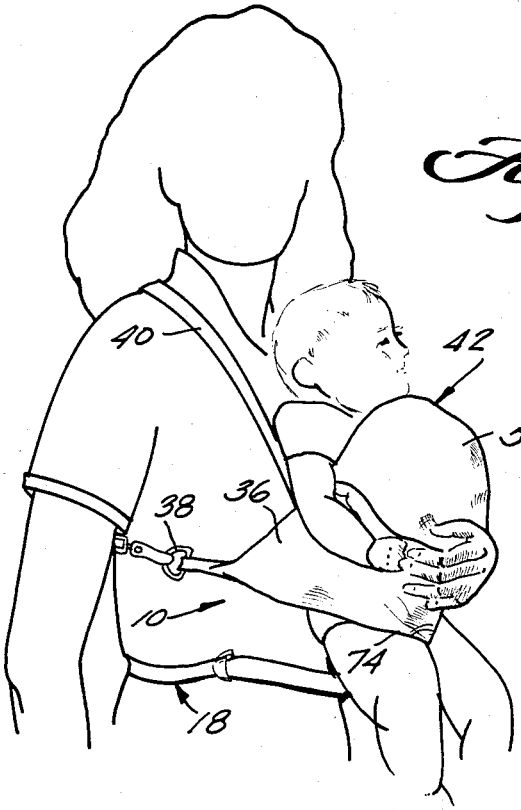
Fig. 3
Fig. 4
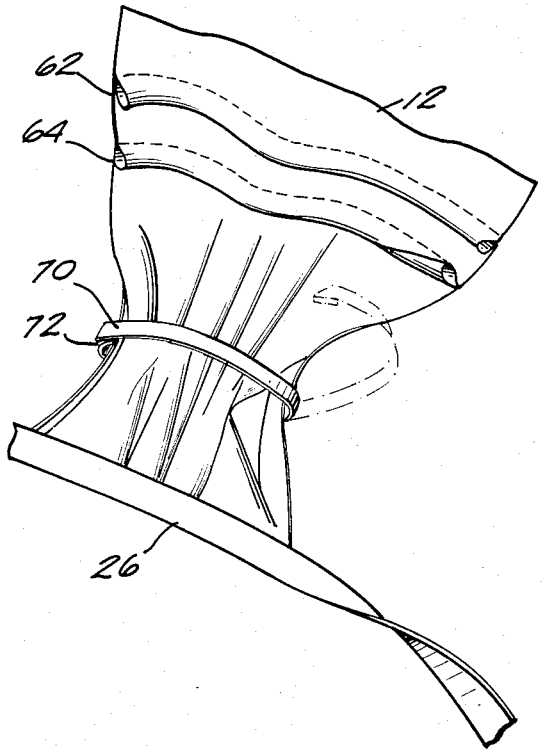
Fig. 5
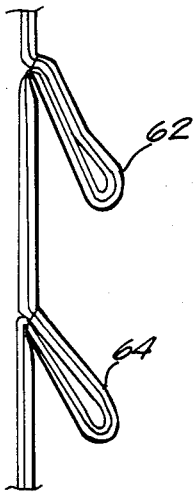

SLING-TYPE INFANT CARRIER

BACKGROUND OF THE INVENTION

In many other cultures, past and present, it has been customary for parents, particularly, but not exclusively, mothers, to carry their infant children against the parents' sides, chests or backs, using a sling-like arrangement of fabric, woven fiber or the like. The practice is particularly well-known from North, Central and South American, Indian and sub-Saharan African traditional cultures, although at times it has been known practically around the world.

Over the last few years, interest in the traditional practice of sling-carrying infants has become considerably heightened in the United States, as it has become increasingly recognized that the practice has advantages for both the infant and the adult. With a well-designed sling, the adult is largely free to go about her or his business while carrying the child, and the child is in possession of an enhanced state of well-being, from being closely associated with another's heartbeat and from not being overwhelmed by a feeling of separation and of being alone in the world.

Although some traditional baby carrier slings are designed for supporting the infant on the adult's hip, most are designed for supporting the infant in a confronting relation either to the adult's back or to the adult's chest. There are some times when it is obvious from the way that the infant is twisting her or his neck about that they would rather be looking out at what is going on around them than to be faced with the relative sameness of their tender's back or chest. However, no available sling-type carriers known to the present inventor easily accommodate an infant in a choice of either facing in or facing out position. Also, with known sling-type infant carriers, growth of the baby may soon strain the capacity of the device, so that the child must suffer being squeezed by a carrier which she or he has outgrown, or a new larger-size carrier must be purchased, borrowed or otherwise acquired.

SUMMARY OF THE INVENTION

A sling-type infant carrier is provided, typically sewn of fabric to include an approximately rectangular body, with a lower set of straps to girdle the adult at mid-torso and an upper set of straps each for crossing over the adult's respective one shoulder and under the adult's opposite underarm. The upper set of straps preferably centrally incorporates a pillow/chinrest. The carrier body preferably includes a plurality of horizontal pleats which may be let out to accommodate growth of the infant. And the carrier body, which is configured to provide the infant with a comfortable seat when the infant is slung in confronting relation, preferably includes an adjustable width-reducing strap for easily reconfiguring the infant carrier for the infant's comfort when the infant is to be carried in a facing-out orientation.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the Drawing

FIG. 3 is a perspective view similar to FIG. 2, but showing the infant carrier in use with a baby being carried in facing-out relation on the adult's chest;

FIG. 4 is a larger scale fragmentary perspective view showing how the carrier body width-reduction strap is used when the baby is to be carried as in FIG. 3; and FIG. 5 is an enlarged fragmentary side elevational view illustrating the baby growth-accommodating pleats.

DETAILED DESCRIPTION

Figure 1:
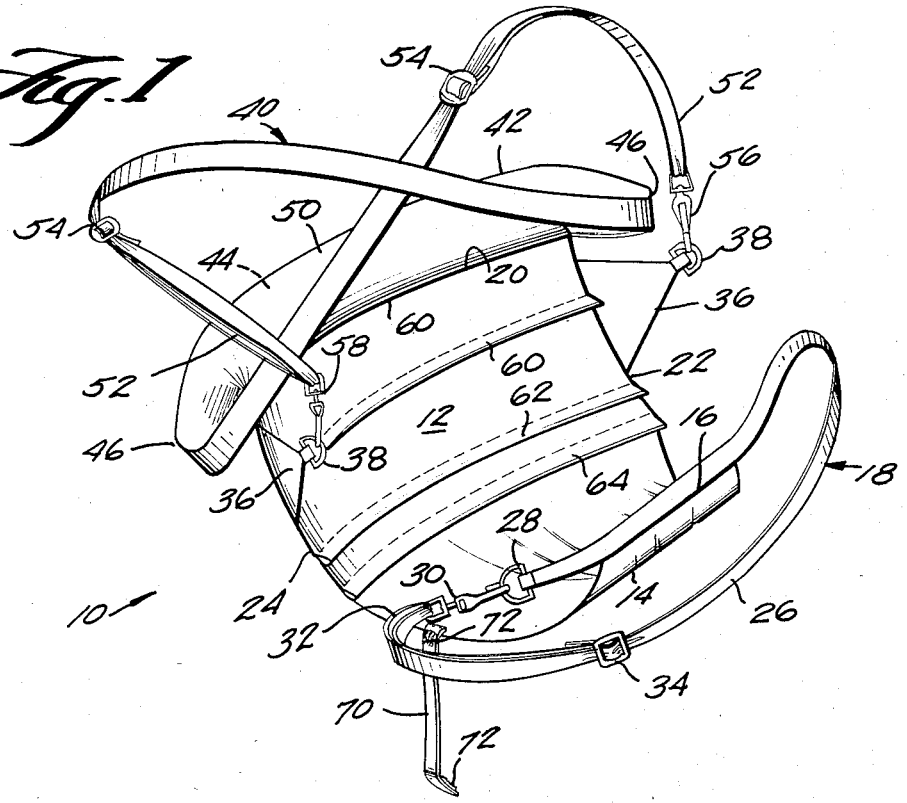
FIG. 1 is a perspective view of the sling-type infant carrier by itself, but arranged as it would be when an infant is being carried therein in confronting relation to the adult's chest. (The direction of view is looking through the adult from the back, and then through the infant, at the carrier.)

The sling-type baby carrier 10 preferably is constructed largely of woven textile fabric, although any strong, preferably washable or cleanable, flexible sheet material of a type which is safe and comfortable for use in close association with a human infant may be used. Generally, the same types of material as currently are used for making infant carriers, and the like may be used. A typical preferrred material has the appearance and hand of a lightweight duck, canvas, drill, denim or the like except for the face of the pillow portion (further described hereinafter) which preferably has a softer hand, e.g. being made of flannel.

The baby carrier 10 is shown including a body portion 12 that is approximately rectangular in form, taller than wide, but centrally gathered, shirred or pleated at 14 along its lower margin 16, e.g. in the course of securing the lower set of straps 18 thereto, so that effectively the body portion 12 is somewhat narrower along its lower margin 16 than along its upper margin 20. Thus, the lateral margins 22, 24 at the left and right, while being generally vertical and generally parallel, do converge especially in the lower approximately one-third of the body.

The body 12 preferably is made of two thicknesses of fabric which are sewn together along their respective margins. It is in the course of sewing these thicknesses together along the lower margin 16 that the lower set of straps 18 may be connected to the lower margin of the body. The lower set of straps 18 in the preferred embodiment is shown comprising a torso girth-encircling strap 26 having a D-ring 28 sewn onto one end and a pivotable clip 30 mounted in a loop 32 which is provided at the opposite end. The loop 32 is defined by a buckle 34 provided on an end of the strap 18 and doubled-back onto the strap 18. Accordingly, whereas the strap 18 is sewn at approximately midway along the length of its upper margin to the lower margin of the body 12, the position of the buckle 34 may be adjusted along the strap to effectively increase and decrease the girth of the loop defined by the strap 18 and the connector 28/30 may be connected and disconnected in order to put on and take off the carrier 10 without modifying the girth setting provided by the buckle 34.

Near the upper margin of the body 12, the side margins of the body 12 are provided with ear-like lateral wings 36 which form the bases for D-rings 38 of the upper set of straps 40.

The upper set of straps 40 is shown further comprising a banana-shaped roll pillow 42 which is stuffed, e.g. with polyester fiber filling 44 only to its lateral margins 46 which typically are in line with the respective D-rings 38. From the margins 46, the material of the outer and inner faces 48, 50 of the pillow 46 come together and continue as the upper set of straps. At each end, the upper set of straps doubles back at a loop 52 that is adjustably maintained with the aid of a buckle 54. Each loop carries a clip 56, 58. The central lower margin 60 of the pillow 42 is sewn to the upper margin of the body 12. The left end of the upper set of straps may be clipped to the right wing D-ring 38 using the clip 56 and the right end of the upper set of straps may be clipped to the left wing D-ring 38 using the clip 58. The upper set of straps when thus clipped, provides two over the shoulder/under the opposite arm loop-like straps for supporting the carrier 10 on the adult wearer. These loops may be opened-up at 38/56 and 38/58 without affecting the adjustments at 54, or may be adjusted at 54, without need for opening up the loops at 38/56 and 38/58.

By preference, the inner face 50 of the pillow (and of the whole upper set of straps) is made of a soft material such as cotton or cotton-blend flannel.

At at least one and preferably a plurality of levels, the body 12 preferably initially is provided with respective pleats 60, 62, 64 which extend across the full width of the body. The pleats 60 and 62 are shown disposed slightly below and slightly above half-way up the body. The pleat 64 is shown provided at the level of the wings 36 and extending out onto the wings nearly to the respective D-rings, and then tapering to extinction. Each pleat is shown taking-up about one inch of the height of the body. Accordingly, as the infant grows, one by one the pleats 60, 62, 64 can be let out by removal of the respective lines of stitching 66, so that there is more room for the baby.

Typically, the distance around the pillow at its center is about nine inches; the lower strap is about forty-four inches long when opened up and adjusted to its full length; the upper strap incorporating the pillow is about eighty-eight inches long when released at both D-rings and adjusted to its full length; the body is about twelve and a half inches wide at its upper margin but near the top is about twenty-three inches wide including the wings 36 and D-rings 38; the body is about five inches wide at the lower margin; and the body is about fourteen to about seventeen inches tall, depending on how many of the pleats are let-out. All these dimensions are exemplary.

Figure 2:
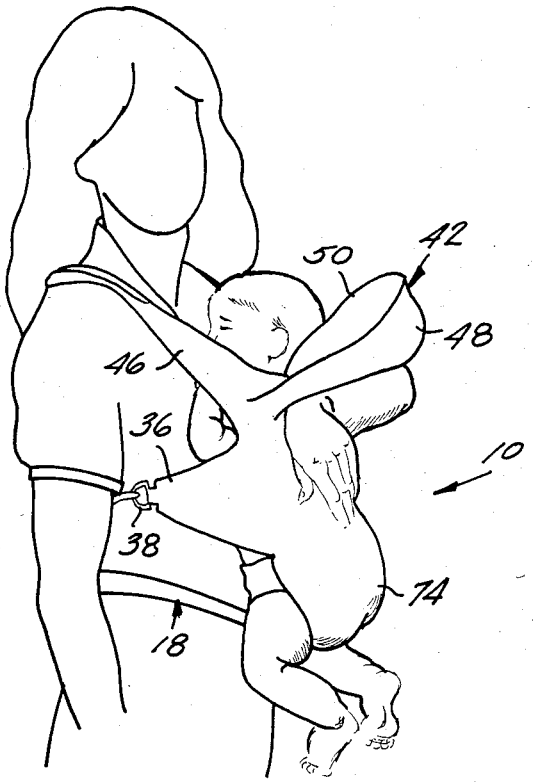
FIG. 2 is a perspective view of the infant carrier in use with a baby being supported in confronting relation to the adult's chest.

By preference, about four inches above the lower margin of the body, a body width adjustment strap 70 is sewn by one end to a respective lateral margin of the body so as to project laterally. A velvet, hook-and-fleece, e.g. Velcro-type fastener 72 is provided, e.g. on the tip of the strap 70 and at its base, or on the body 12 at the level of the strap 70. This strap 70 and fastener is surplus when the device 10 is being used for carrying a child in confronting relation to the adult as shown in FIGS. 1 and 2. However, it has an important use when the device 10 is used for carrying the infant in a facing-out relation as shown in FIG. 3. That use is depicted in an isolated way in FIG. 4.

It should now be evident that when the infant is being carried in confronting relation, that the carrier body 12 should be relatively wide at the level 74, so as to provide generous full-width support for the infant's bottom. However, if one were to attempt to carry the infant in a facing-out relation, the same width of material at the level 74, instead of needing to be wide to support the baby's bottom, needs to be narrow in order to fit between the baby's legs without producing uncomfortable leg-spreading pressure and chafing at its lateral margins. And that is where use of the strap 70 comes into play. When the baby is to be carried in a facing-out relation, the adult simply loops the strap completely around the body, and fastens the fastener 72 to itself. In the device of the example, this cinching decreases the width of the body at the level 74 to about three and one-half inches. (Again, these dimensions are exemplary).

The various connectors and methods of construction and fastening as described herein are exemplary. For instance, fiber bonding, adhesives, laser welding and the like may be used in place of sewing.

As should be apparent by comparing FIGS. 1 and 2 with FIG. 3, when the baby is being carried in confronting relation, the pillow is in an "up" position and acts as a head rest and lateral protector for the infant and the infant may extend her or his arms between the upper strap and wing at each respective side of the device 10. And when the baby is being carried in facing-out relation, the pillow may be folded down so that it provides a chin support for the infant, whose arms may then extend over the upper straps. Because the padding of the pillow preferably extends laterally beyond the edges of the body, when the baby's arms come over the upper straps, it is at sites where the upper straps are padded and thus do not uncomfortably engage the baby.

The term "adult" is used broadly herein so as to include such older person, whether or not technically over the threshold age of adulthood, who may be using the device 10. For instance, a babysitter or older sibling may be the person who is using the device 10 to carry an infant.

It should now be apparent that the sling-type infant carrier as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A sling-type infant carrier, comprising:

an approximately retangular body made of flexible material, said body having respective upper, lower, left lateral and right lateral margins;

a length-adjustable lower strap means having two opposite ends and first connector means for disconnectably connecting these ends together in encircling relation to the girth of an adult user at mid-torso level for facilitating donning and doffing of the sling-type infant carrier;

said lower strap means having a central portion thereof connected to the body in the vicinity of said lower margin, at least by said left and right lateral margins;

a length-adjustable upper strap means having two opposite ends and having a central portion thereof secured to said body along said upper margin of said body;

second connector means associated with one of said ends of said upper strap means for disconnectably connecting that end to said left lateral margin of said body below where said central portion of said upper strap means is secured along the upper margin of said body, with a respective portion of said upper strap means adjoining said second connector means, obliquely crossing the adult user's torso and extending over the adult user's right shoulder to the right lateral margin of said body;

third connector means associated with the other of said ends of said upper strap means for disconnectably connecting that end to said right lateral margin of said body below where said central portion of said upper strap means is secured along the upper margin of said body, with a respective portion of said upper strap means adjoining said third connector means, obliquely cross the adult user's torso and extending over the adult user's left shoulder to the left lateral margin of said body;

said upper strap means being stuffed with pillow stuffing material along the width of said upper margin of said body and along adjoining portions thereof extending laterally leftwards and rightwards beyond the respective lateral margins of said body so as to provide a pillow which is substantially more laterally extensive than is said body at said upper margin, with said pillow thereby extending over where said upper strap means is disconnectably connected by said second and third connector means to said left and right lateral margins of said body;

whereby said body is constructed and arranged to be supported sling-fashion on the torso of the adult user between the upper strap means and the lower strap means.

2. The sling-type infant carrier of claim 1, wherein:

said second and third connector means each include a respective laterally elongated wing of flexible material extending laterally outwards from the respective lateral margin of said body, with a connector being provided on each said wing distally of said body, each such connector being constructed and arranged to disconnectably connect with a respective said end of said upper strap means.

3. The sling-type infant carrier of claim 1, wherein:

an inner face of said upper strap means, at least to the lateral extent of said stuffing, is constituted by an especially soft fabric in the nature of cotton flannel.

4. The sling-type infant carrier of claim 1, further including:

at least one horizontally extending row of releasable pleat means on said body which when released increases the effective length of said body.

5. The sling-type infant carrier of claim 4, wherein:

at least one row of said pleat means is provided at the level of said wings and extends onto said wings.

6. The sling-type infant carrier of claim 1, further including:

means on said body for adjusting the width of the body about one-third of the way up the body from said lower margin, so that the body may be disposed in a wide mode for supporting an infant's bottom when the infant is to be carried in a confronting relation to the wearer of said sling-type infant carrier and in a narrow mode for passing between the infant's thighs when the infant is to be carried in a facing-out relation to the wearer of said sling-type infant.

7. The sling-type infant carrier of claim 6, wherein:

said adjusting means comprises a strap, and means for releasably connecting the strap to itself with the strap encircling the body.

8. The sling-type infant carrier of claim 7, further comprising:

means securing said strap to said body and means providing respective elements of a hook and fleece-type fastener to said strap at means providing two opposite ends of said strap.

* * * * *